United States Patent [19]

Fischer

[11] 4,401,212

[45] Aug. 30, 1983

[54] TWO BOTTLE CARRIER

[76] Inventor: David Fischer, 12 Cavotti Crescent, Downsview, Ontario, Canada, M3H 4V1

[21] Appl. No.: 352,175

[22] Filed: Feb. 25, 1982

[51] Int. Cl.[3] ..... B66C 1/10; B65D 75/00; B65D 85/62

[52] U.S. Cl. ..... 206/158; 206/199; 294/87.2; 294/87.26

[58] Field of Search ..... 206/158, 199; 294/87.2, 294/87.26

[56] References Cited

U.S. PATENT DOCUMENTS

| | | | |
|---|---|---|---|
| 2,252,235 | 8/1941 | Snelling | 206/158 |
| 2,320,440 | 6/1943 | Kruea et al. | 206/158 |
| 2,604,354 | 7/1952 | Gray | 294/87.26 |
| 2,813,746 | 11/1957 | Goldsmith et al. | 206/158 |
| 3,073,644 | 1/1963 | Baker et al. | 206/158 |

*Primary Examiner*—William T. Dixson, Jr.

[57] ABSTRACT

A bottle carrier is formed by means of first and second panels interconnected by a longitudinally extending fold line. The first panel is provided with a first pair of aperatures spaced longitudinally and symetrically positioned on opposite sides of a transverse line substantially perpendicular to the fold line while the second panel is provided with a second pair of aperatures (larger than the first pair) spaced longitudinally on the second panel symetrically on opposite sides of the transverse line. Connecting passages traverse the longitudinal fold line and connect adjacent of said first and second aperatures. These connecting passages slope from a first aperature towards the adjacent second aperature in a direction away from the transverse line. A portion of the boundary of each of the passages adjacent to the transverse line in the second panel are spaced further from the center line than the boundary of the passages formed in the first panel, the aperatures are positioned and sized so that with necks of bottles passing through said first aperatures, said second panel may be folded on said longitudal fold line into overlying relationship with said first panel with a portion of said neck projecting through the adjacent of the second aperatures and said portion of the boundaries of each of said passages in said second panel positioned to overly an adjacent portion of each of said passages in said first panel to reduce the effective width of said passages and thereby to retain a bottle therein.

6 Claims, 7 Drawing Figures

TWO BOTTLE CARRIER

FIELD OF THE INVENTION

The present invention relates to a two bottle carrier, more particularly the present invention relates to a relatively simple handle carrier adapted to suspend a pair of bottles in side by side relationship from collars around their necks.

BACKGROUND TO THE INVENTION

Bottle carriers where the neck of the bottle is inserted through a hole in a carrier and suspended via a shoulder on the bottle engaging the edge of the hole on the carrier are known. Such devices are shown, for example, in Canadian Pat. No. 395,066 issued Mar. 11, 1941 to Gray and Canadian Pat. No. 387,720 issued May 2, 1940 to Hawkins. In the Hawkins device bottles are held to a supporting panel by inserting the neck of a bottle through an aperature in the panel and then applying a metal clip to prevent the bottle from pulling back through the aperature. The device of Gray uses a pair of face to face panels, each of which is provided with an aperature through which the neck of a bottle is projected, when the bottle is carried the two panels slide relative to one another, thereby changing the size of the aperature and preventing the bottle from sliding back down and out.

Other more complicated devices for carrying bottles by engaging the neck or shoulder around the neck of the bottle are shown for example in Canadian Pat. Nos. 805,519 issued Feb. 4, 1969 to Skillen or 978,901 issued Dec. 2, 1975 to Gauntlett or in the Klygis Pat. Nos. 967,522 and 996,514 issued May 13, 1975 and Sept. 7, 1976. All of these devices provide intricate folding panels that wrap around the neck of the bottle and project down the neck of the bottle a significant distance with the cap being contained or held by at least one upper panel.

Canadian Pat. No. 1,039,688 to Graser issued Oct. 3, 1978 provides an upwardly projecting handle structure that holds the bottles by deflecting tabs surrounding each aperature through which the cap of the bottle is projected. Tabs are folded out of the way as the bottle moves through the aperature and then engage under the cap of the bottle to prevent the bottle from falling back through.

BRIEF DESCRIPTION OF THE PRESENT INVENTION

The present invention provides a relatively inexpensive carrier for carrying two bottles by means of a hand hold grip projecting above the top of the bottle.

Broadly the present invention relates to a bottle carrier comprising first and second panels interconnected via a longitudinally extending fold line, a first pair of aperatures spaced longitudinally in said first panel and symetrically positioned on opposite sides of a transverse line substantially perpendicular to said fold line a second pair of aperatures larger than said first pair of aperatures in said second panel, said second pair of aperatures being spaced longitudinally on said second panel and symmetrically positioned on opposite sides of said transverse line, connecting passage means traversing said longitudinal fold line and connecting adjacent of said first and second aperatures, each of said connecting passage means sloping from said first aperature towards said second aperature in a direction away from said transverse line, a portion of the boundary of each of said passages adjacent said transverse line on said second panel being spaced farther from said transverse line than said boundary on said first panel, said aperatures being positioned and sized so that with necks of bottles passing through said first aperatures said second panel may be folded on said fold line into position overlying said first panel with a portion of said neck extending through one of said first aperatures projecting through the adjacent of said second aperatures and said portion of said boundary of each of said passages in said second panel positioned to overly an adjacent portion of its said connecting passage in said first panel to reduce the effective width of the said passages.

The carrier is adapted to be used with bottles having anular collars around their necks, the second aperatures are large enough to permit the collars to pass therethrough while the first aperatures and the passages are wide enough to permit the neck portion to slide from the second aperatures into the first aperatures but are smaller than the collar, when the second panel is folded into overlying relationship with the first panel a portion of the said boundary of the passage in the second panel interferes with movement of the bottles by engagement with the neck of the bottle above the collar i.e. it reduces the effective width of the passage when the second panel is folded over the first.

If desired an advertising and reinforcing panel may be foldably connected to the end of the second panel remote from said longitudinal fold line by means of a second longitudinal fold line, normally the second panel will be provided with a hand hole and the advertising panel will be of a length measured perpendicular to said fold line such that when said advertising panel is folded into face to face relationship with the second panel the outer edge of the advertising panel is immediately above the top of the hand hole and thereby reinforces the hand hole when the carrier is being used to carry bottles.

Further features, objects and advantages will be evident from the following detailed description of the preferred embodiments of the present invention taken in conjunction with the accompanying drawings in which.

Figure 1:
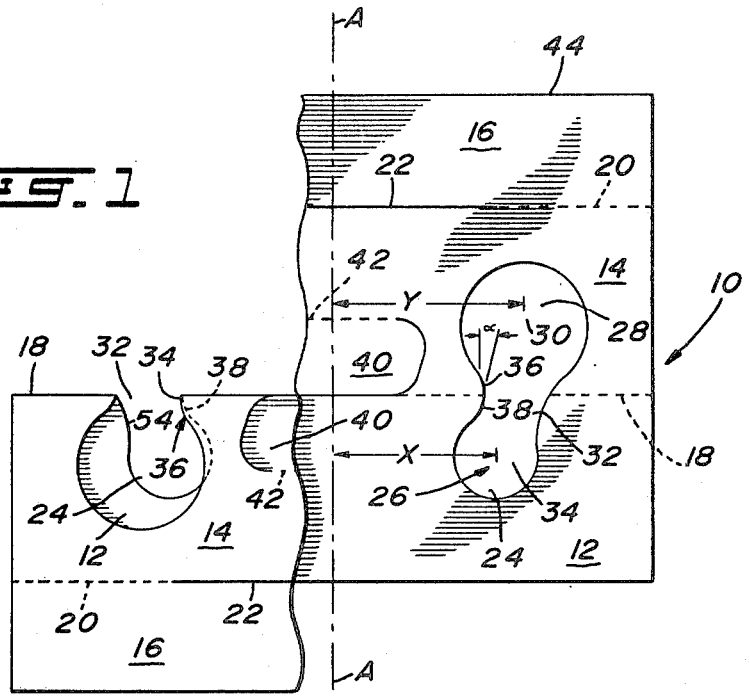
FIG. 1 is a plan view of a blank incorporating the present invention with the left hand side folded over to illustrated locking operation.

The blank 10 illustrated in FIG. 1 is symetrical on the left and right hand sides of the transverse (center) line A—A. A significant portion of the blank to the left of the line A—A is illustrated folded over into locking position. To simplify the description on the right hand side of the blank will be described in detail, it being apparent that the left hand side is substantially identical.

The blank 10 is composed of a first panel 12, a second panel 14 and an optional third panel 16 foldably connected via fold lines 18 and 20 respectively.

The panel 16 is connected to the panel 14 via fold line 20 which in the centre is formed into a slit 22 provides a reinforcing for the handle as will be described herein below as well as an advertising space that is exposed when the carrier is in locked position on the top pair of bottles. This slit 22 facilitates folding of the panel 16 relative to the panel 14.

The first panel 12 is provided with an aperature 24 adapted to snugly receive the neck of a bottle. In the illustrated arrangement the aperature 24 is substantially circular and has its centre schematically indicated at 26 spaced a distance x from the transverse centre line A—A. Obviously the aperature 24 need not be circular, it simply must embrace the neck of the bottle without permitting the collar extending there around (as will be described herein below) from passing therethrough.

The second panel 14 is provided with an aperature 28, again of partial circular cross-section although this is not essential, having it centre 30 spaced from the transverse centre line A—A at distance Y. The aperature 28 is adapted to permit the flange or collar around the neck of the bottle to pass completely therethrough.

The distance Y is greater than the distance x so that the centre of the smaller aperature 24 is in effect closer to the centre line A—A than the centre of the larger aperature 28.

The aperatures 24 and 26 are interconnected via a passage 32 that is sufficiently wide to permit the neck of a bottle to pass therethrough but narrower than the diameter of the collar around the neck of the bottle to be carried. The Passage 30 slopes from the smaller aperature 24 toward the larger aperature 28 in a direction away from the transverse line A—A so that when a bottle is moved from the larger aperature 28 into the smaller aperature 24 it moves toward the transverse line A—A.

The wall 34 of the passage 32 closest to the transverse centre line A—A in the illustrated arrangement traverses the fold line 18 at an angle and this wall slopes when moving from the aperature 24 towards the aperature 28 in a direction away from the transverse centre line A—A. The importance of this slope as indicated by the angle $\alpha$ is to ensure that the portion 36 of the wall 34 in the panel 14 be spaced farther from the transverse centre line A—A than the portion 38 of the wall 34 formed in the panel 12 so that when the panel 14 is folded into overlying relationship with the panel 12 portion 36 will project into the passage 32 and obstruct movement of a bottle as will be described below.

It will be apparent that the distance Y is greater than the distance X and that the aperatures 24 and 28 are in overlying position when the panel 14 is folded over the panel 12 as shown to the left in FIG. 1. The aperature 28 is sufficiently large and is located so that it receives the top of a bottle retained in the aperature 24 as the panels are folded as will be described herein below.

A suitable handle panel 40 is formed in the panel 14 by a line of severence 41 through the panel 14 having its ends interconnected by a fold line 42 substantially parallel to the fold lines 18 and 20. The panel 40 is between the fold line 42 and the panel 12. Preferably the distance between the fold line 42 and the slit or fold line 20 will be substantially equal to the distance between the fold line 20 and the outer free edge 44 of the panel 16 so that in carrying position the edge 14 cooperates with the fold line 42 to reinforce the handles so formed.

Figure 2:
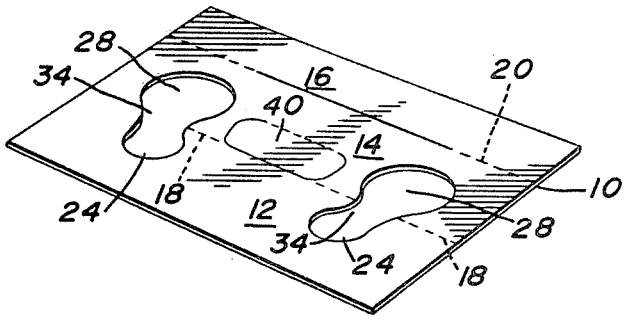
FIG. 2 is a schematic isometric of the blank of the present invention.

In operation the blank is laid out as shown in FIG. 2 and moved downward over the two bottles schematically indicated at 46 and 48 so that the tops 50 of the bottles and their collars 52 project up through the aperatures 28 in the panel 14 i.e. the panel 14 is positioned immediately below the collars 52 on the bottles 46 and 48 respectively.

Figure 3:
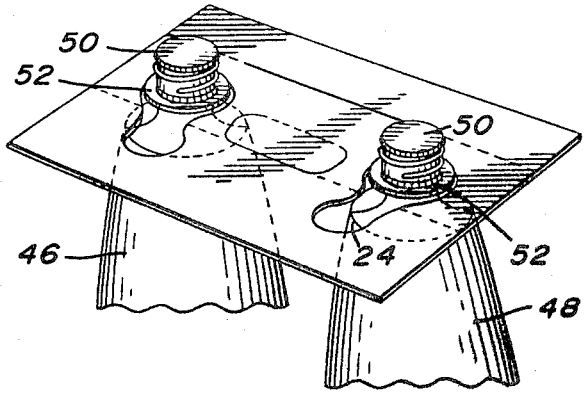
FIG. 3 shows a pair of bottles inserted through the aperatures in the second panel.

The blank is then moved so that the necks of the bottles pass through the passages 34 into the aperatures 24 as shown in FIG. 3 with the collars 52 resting on the surface of the panel 12 i.e. the passages 32 and aperatures 24 are large enough to pass the necks of the bottles but smaller than the collars 52.

Figure 5:
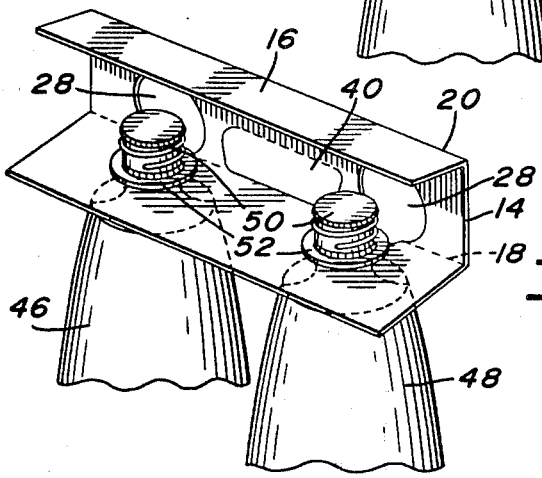
FIG. 5 shows the second panel about to be folded over on top of the bottles and the first panel to lock the bottles in position.
Figure 6:
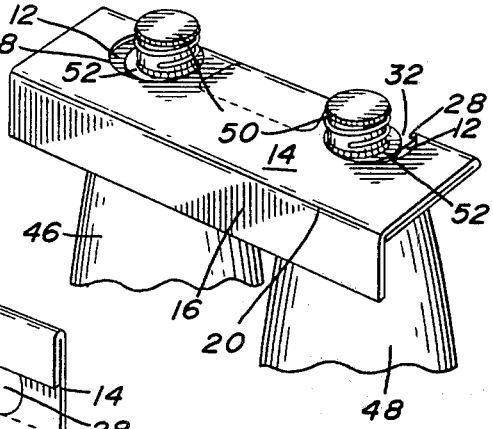
FIG. 6 shows the second panel in overlying relationship to the first panel with the advertising panel hanging in exposed position and, FIG. 7 illustrates opening of the carrier and movement towards the carrying position and illustrating how the advertising panel reinforces the hand hole.

The panel 14 is then folded along foldline 20 into overlying relationship with panel 12 as indicated in FIGS. 5 and 6 so that the tops 50 again project through the aperatures 28 and the passage 34 is partially obstructed by the portion 36 of the wall 34 as will be described herein below thereby locking the bottles in position. The panel 16 is folded down in front of the bottles to display the advertising printed thereon.

Figure 7:
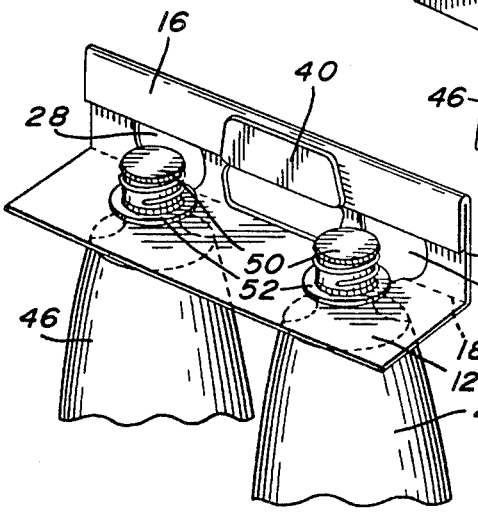

When the bottles are to be carried the panels 16 and 14 are lifted and the panel 16 folded into face to face relationship with the panel 14, a hand inserted through the handhold formed by the panel 40, and the panel 40 folded to overly the panel 16 and trap same between itself and the panel 14 and with the free edge 44 immediately adjacent the fold line 42 to provide a reinforced handle for lifting of the two bottles as shown in FIG. 7.

Figure 4:
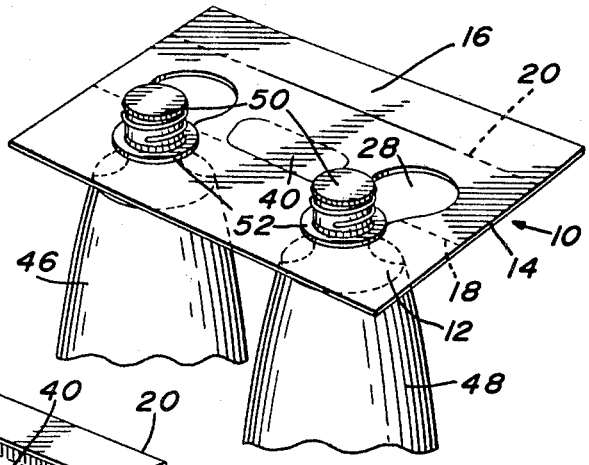
FIG. 4 is an isometric view with the bottles in their final resting place in the aperatures in the first panel.

It will be noted that as the bottles and blank are relatively moved from the FIG. 3 to the FIG. 4 position the bottles 46 and 48 are moved together since the spacing X between the centre line A—A and the centre 26 is shorter than the distance Y between the centre line A—A and the centre 30. Final spacing between the bottles is such that the sides of the bottles just contact each other when the necks are received within the aperatures 24 on opposite sides of the centre line A—A of the blank thereby to stabilize the bottle for better carrying.

As above indicated the bottles are locked in position when the blank is folded into the position shown in FIG. 6, this is clearly indicated in FIG. 1 on the left hand side where the panel 14 is shown folded over onto the panel 12. As will be evident when the panel 14 is folded over onto the top of the panel 12 the portion 36 of the boundary 34 which is farther from the centre line A—A than the portion 38 obstructs movement by narrowing the effective width of the passage 34 i.e. the portion 36 overlies the collar 52 on the bottle and engages the portion of the bottle projecting above the collar 52 i.e. the top 50 and prevents the bottle from moving from the FIG. 4 position back to the FIG. 3 position. It can be clearly seen from FIG. 1 on the left that the effective width of the passage 34 is narrowed as indicated in the area of 54 to a width less than the width of the neck of the bottle.

Having described the invention modifications will be evident to those skilled in the art without departing from the spirit of the invention as defined in the appended claims.

I claim:

1. A bottle carrier comprising first and second panels interconnecting via longitudinally extending fold line, a first pair of aperatures spaced longitudinally in said first panel symetrically positioned on opposite sides of a line extending substantially perpendicular to said fold line, the second pair of aperatures larger than said first pair of aperatures in said second panel, said second pair of aperatures being spaced longitudinally in said second panel symetrically on opposite sides of said transverse line, connecting passage means transversing said longitudinal fold line and connecting adjacent of said first and second aperatures, each of said connecting passage means sloping from said first aperature toward said second aperature in a direction away from said transverse line, a portion of the boundary of each of said passages adjacent said transverse line on said second panel being spaced further from said transverse line than said boundary on said first panel, said aperatures being positioned and sized so that with necks of bottles passing through said first aperatures said second panel may be folded on said fold line into position overlying said first panel with a portion of said necks projecting from one of said first aperatures projecting through the adjacent of said second aperatures and said portion of said boundary of each of said passages in said second panel being positioned to overly the adjacent portion of its said passage in said first panel to reduce the effective width of said passages.

2. A carrier as defined in claim 1 wherein said first aperatures are placed on opposite sides of said transverse line so that bottles suspended from said first aperatures have their adjacent side edges in contact.

3. A carrier as defined in claim 2 wherein said bottles are provided with collars around their necks wherein said first aperatures and said passage are wide enough to receive said necks and permit same to slide from said second aperature into said first aperature but are smaller than said collars so that said collars rest on the surface of said first panel when a bottle is received within said first aperature.

4. A carrier as defined in claim 3 wherein when said second panel is folded into overlying relationship with said first panel and with bottles contained in said carrier, said second panel overlies said collars and said portions of said boundaries of said passages in said second panel interfere with movements of said bottles by engagement with the necks of the bottles above the collars.

5. A bottle carrier as defined in claims 1, 2 or 3 further comprising an advertising panel foldably connected to the end of said second panel remote from said first panel via a fold line substantially parallel to said longitudinal fold line.

6. A bottle carrier as defined in claims 1, 2 or 3 further comprising a hand hole formed in said second panel by a line of weakness and a second fold line, said second fold line extending substantially parallel to and spaced from said longitudinal fold line and being positioned between said second pair of aperatures symetrically relative to said transverse line.

* * * * *